US008089011B2

(12) United States Patent
Wang

(10) Patent No.: US 8,089,011 B2
(45) Date of Patent: Jan. 3, 2012

(54) CONTROL MECHANISM AND ELECTRONIC DEVICE USING THE SAME

(75) Inventor: Wei-Jun Wang, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 275 days.

(21) Appl. No.: 12/632,953

(22) Filed: Dec. 8, 2009

(65) Prior Publication Data

US 2011/0073445 A1 Mar. 31, 2011

(30) Foreign Application Priority Data

Sep. 29, 2009 (CN) ..... 200910307955

(51) Int. Cl.
*H01H 9/28* (2006.01)

(52) U.S. Cl. ..... 200/43.01

(58) Field of Classification Search ..... 200/43.01, 200/11 R, 11 A, 11 D, 11 DA, 11 J, 11 TW, 200/564, 565, 567–569, 571, 336
See application file for complete search history.

(56) References Cited

U.S. PATENT DOCUMENTS

| | | | | |
|---|---|---|---|---|
| 6,974,921 | B2 * | 12/2005 | Jørgensen et al. | 200/14 |
| 7,166,810 | B2 * | 1/2007 | Hanahara et al. | 200/11 R |
| 7,550,685 | B2 * | 6/2009 | Tsuduki | 200/6 A |
| 7,962,106 | B2 * | 6/2011 | Gong et al. | 455/90.2 |
| 2008/0011590 | A1 * | 1/2008 | Montalvo et al. | 200/11 R |
| 2009/0045038 | A1 * | 2/2009 | Worones et al. | 200/11 DA |

* cited by examiner

*Primary Examiner* — Edwin A. Leon
(74) *Attorney, Agent, or Firm* — Altis Law Group, Inc.

(57) ABSTRACT

A control mechanism includes a control, a mounting plate, and a printed circuit board. The control includes a rotary main body, a contact member connected to the rotary main body, and at least one limiting protrusion extending from a side of the rotary main body. The mounting plate includes a through hole receiving the control, and a blocking portion extending from an inner surface of the through hole. The blocking portion defines at least one cutout. The printed circuit board includes a resilient contact. The at least one limiting protrusion is blocked by the blocking portion until the rotary main body is rotated to a portion whereby the at least one limiting protrusion aligns with the at least one cutout, such that the contact member impels the resilient contact.

20 Claims, 5 Drawing Sheets

CONTROL MECHANISM AND ELECTRONIC DEVICE USING THE SAME

BACKGROUND

1. Technical Field

The present disclosure generally relates to device controls and, particularly, to an electronic device control preventing accidental operation.

2. Description of Related Art

Electronic devices such as computers and notebook computers often utilize a power control and a reset control. In use, the electronic device may be inadvertently powered down by accidental activation of the controls, resulting in possible data loss.

Therefore, there is room for improvement within the art.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout several views, and all the views are schematic.

DETAILED DESCRIPTION

Figure 1:
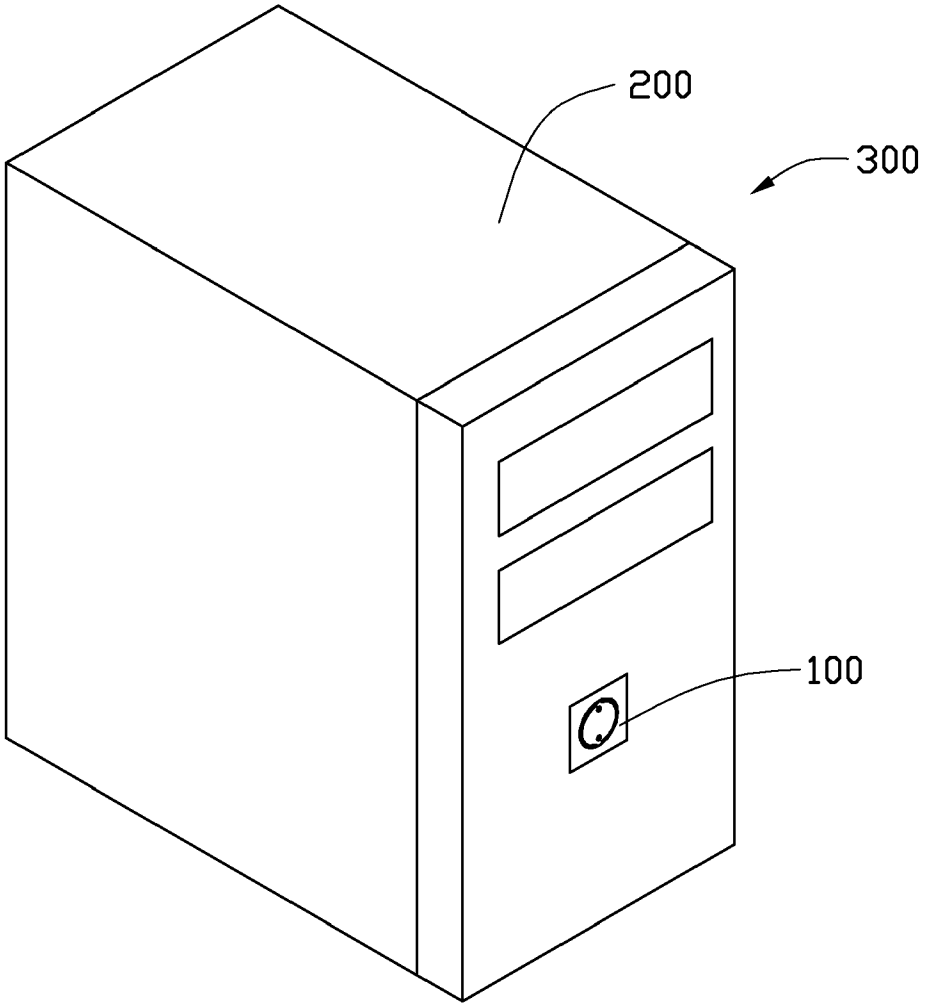
FIG. 1 is an assembled, isometric view of an embodiment of an electronic device having a control mechanism.

Referring to FIG. 1, a control mechanism 100 is utilized in an electronic device 300, such as a computer host. The electronic device 300 includes a housing 200. The control mechanism 100 is fixed to a side of the housing 200 and controls electrical power. The electronic device 300 includes various modules for performing corresponding function and features, however for simplicity, only the module related to the control mechanism 100 will be described. In the illustrated embodiment, the control mechanism 100 is a power control mechanism. In alternative embodiments, the electronic device 300 can be other electronic devices, such as a notebook computer, a machine tool, and an electronic control box.

Figure 2:
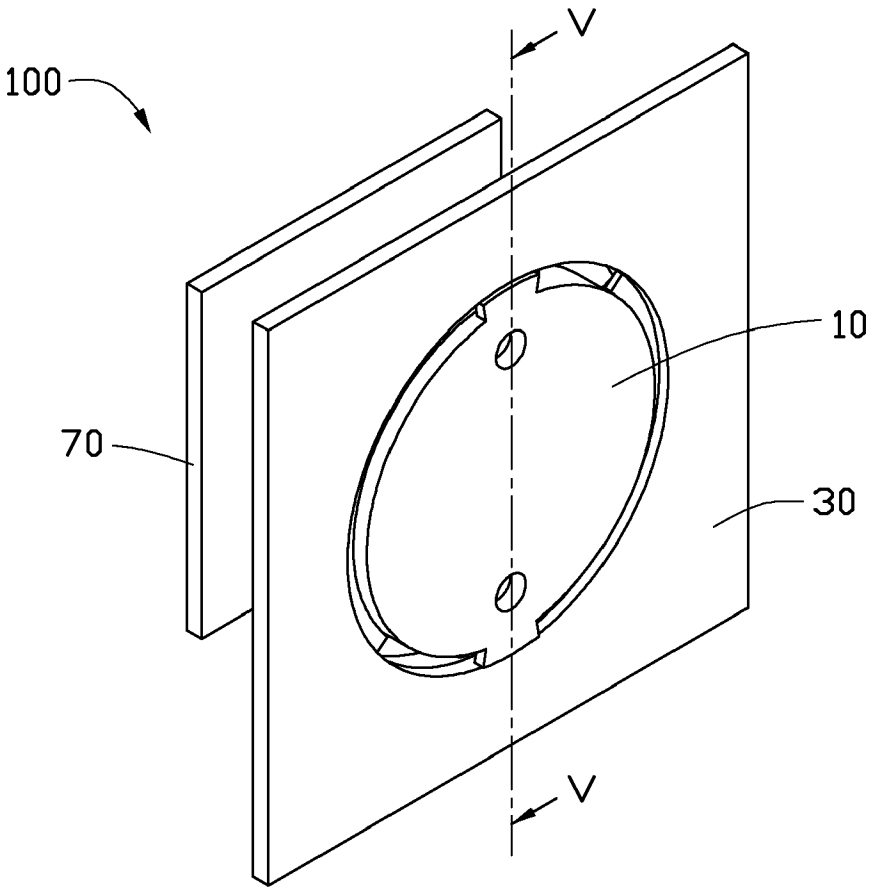
FIG. 2 is an enlarged, isometric view of a control mechanism as disclosed, utilized in an electronic device such as, for example, that of FIG. 1.

Referring to FIG. 2, the control mechanism 100 includes a control 10, a mounting plate 30, and a printed circuit board 70.

Figure 3:
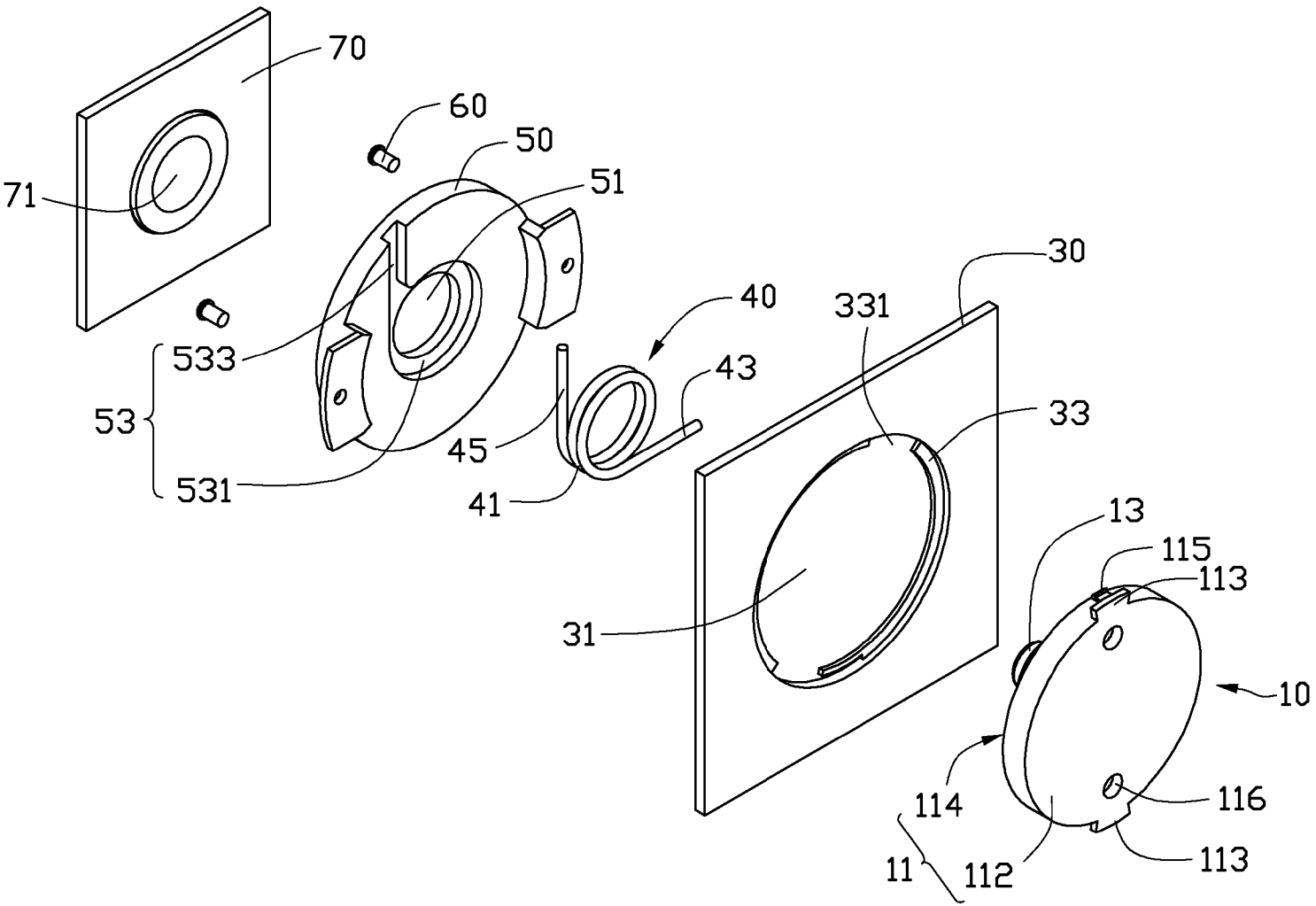
FIG. 3 is an exploded, isometric view of the control mechanism of FIG. 2.
Figure 4:
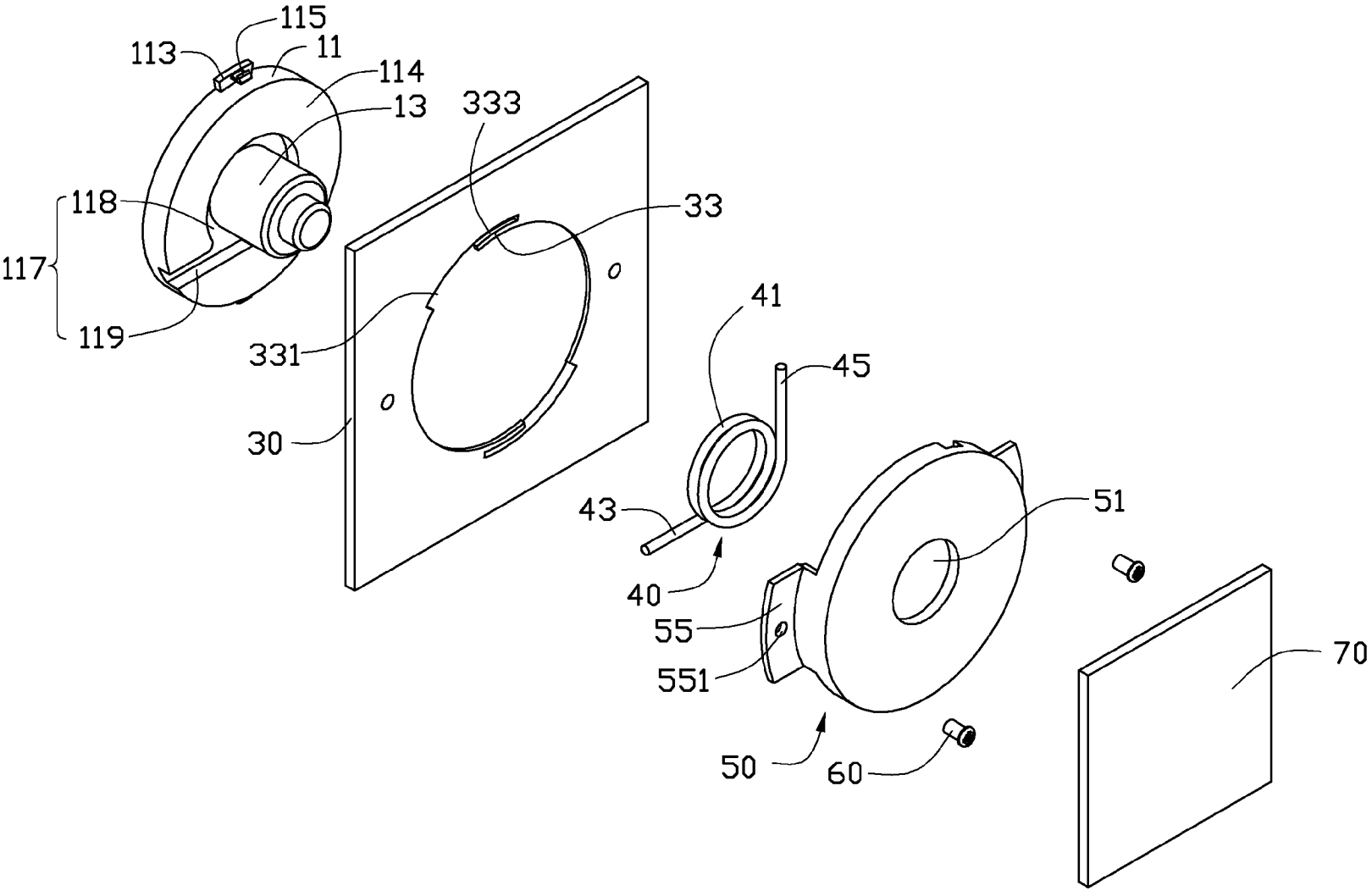
FIG. 4 is similar to FIG. 3, but viewed from another aspect.

Referring to FIGS. 3 and 4, the control 10 includes a rotary main body 11 and a contact member 13. The rotary main body 11 is a substantially circular sheet. The rotary main body 11 includes a first surface 112 and a second surface 114 opposite to the first surface 112. The contact member 13 is a shaft formed at the second surface 114 of the rotary main body 11. The rotary main body 11 defines two separate operating depressions 116 in the first surface 112 allowing rotation of the control 10. The control 10 further includes two limiting protrusions 113 extending from a side of the rotary main body 11. The two limiting protrusions 113 are symmetrical to a center of the first surface 112, and coplanar with the first surface 112. A thickness of the two limiting protrusions 113 is less than that of the rotary main body 11. The control 10 further includes two hooks 115 each extending from each limiting protrusion 113 toward the contact member 13.

The mounting plate 30 includes a through hole 31 receiving the control 10 therein, and a blocking portion 33 extending from an inner surface of the through hole 31 adjacent to an end of the through hole 31 away from the control 10. The through hole 31 is substantially circular, and about the same size as the rotary main body 11 of the control 10. The blocking portion 33 defines two separate cutouts 331. The two cutouts 331 are symmetrical relative to a center of the through hole 31. In the illustrated embodiment, the blocking portion 33 is a substantially annular protrusion. A thickness of the blocking portion 33 is less than that of the mounting plate 30. A width of each cutout 331 is greater than or equal to that of each limiting protrusion 113.

The blocking portion 33 further defines two sliding grooves 333 adjacent to the corresponding cutout 331 and communicating with the corresponding cutout 331. Each sliding groove 333 extends along a circumference substantially parallel to a circumference of the through hole 31. The hooks 115 of the rotary main body 11 are received in the corresponding sliding groove 333 and engage with the blocking portion 33.

The control mechanism 100 further includes a torsion spring 40 and a fixing board 50. The fixing board 50 is fixed to a surface of the mounting plate 30 away from the control 10. The torsion spring 40 is engaged between the fixing board 50 and the rotary main body 11 of the control 10 to provide elastic force.

Referring to FIG. 3 again, the torsion spring 40 includes a columnar body 41, with a first end 43 and a second end 45 extending from two ends thereof. The torsion spring 40 provides a resilient force, for example, a restoring resilient force when the torsion spring 40 is compressed. An angle defined by the first end 43 relative to the second end 45 is substantially 90°. Referring to FIG. 4 again, the second surface 114 of the rotary main body 11 facing the mounting plate 30 defines a first receiving depression 117 to receive a part of the torsion spring 40. The first receiving depression 117 includes an annular depression 118 surrounding the contact member 13 to receive a part of the body 41 and an elongated depression 119 extending from the annular depression 118 to an edge of the second surface 114 to receive the first end 43.

The control mechanism 100 further includes two fasteners 60. The fixing board 50 is a substantially circular plate. The fixing board 50 defines a through hole 51 in a center portion of the fixing board 50 through which the contact member 13 passes. The fixing board 50 further defines a second receiving depression 53 at a surface of the fixing board 50 facing the mounting plate 30 to receive a part of the torsion spring 40. The second receiving depression 53 includes an annular depression 531 surrounding the through hole 51 to receive a part of the body 41 and an elongated depression 533 extending from the annular depression 531 to an edge of the fixing board 50 to receive the second end 45. The fixing board 50 further includes two ear portions 55 fixed to the surface of the fixing board 50 facing the mounting plate 30. Each ear portion 55 defines a fastener hole 551. The fixing board 50 is fixed to the mounting plate 30 by the fasteners 60 engaging the fastener holes 551.

Figure 5:
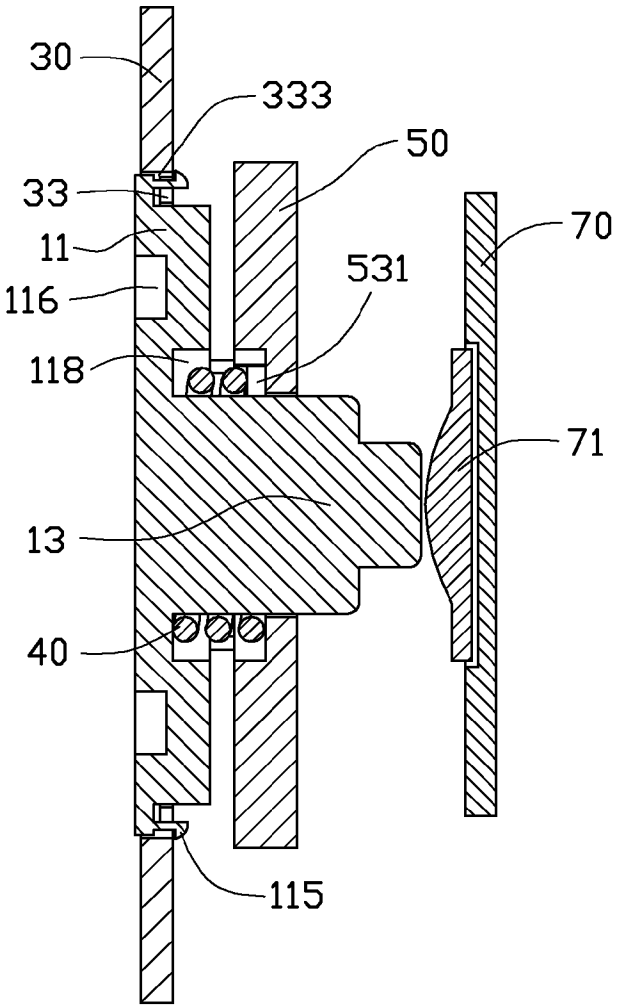
FIG. 5 is a cross-section of the control mechanism of FIG. 2, taken along line V-V.

Referring to FIG. 5, the printed circuit board 70 is fixed in the electronic device 300 corresponding to the control 10. The printed circuit board 70 includes a resilient contact 71. The resilient contact 71, when compressed by the contact member 13, sends an electrical signal. The compressed resilient contact 71 automatically returns to its original state when force from contact member 13 is withdrawn.

To assemble the control 10 into the mounting plate 30, the torsion spring 40 is first received in the second receiving depression 53 of the fixing board 50. The second end 45 of the torsion spring 40 is received in the elongated depression 533 of the second receiving depression 53, and the body 41 of the torsion spring 40 is received in the annular depression 531 of the second receiving depression 53. The fixing board 50 with the torsion spring 40 is then fixed to the mounting plate 30 by fasteners 60 engaging the fastener holes 551. Next, the limiting protrusions 113 of the rotary main body 11 are placed above the corresponding cutouts 331, and the hooks 115 pass through the corresponding cutouts 331. The contact member 13 then passes through the through hole 31 of the mounting plate 30 and the through hole 51 of the fixing board 30. The rotary main body 11 is received in the through hole 31 of the mounting plate 30. The first end 43 of the torsion spring 40 is received in elongated depression 119 of the rotary main body 11. The other part of the body 41 of the torsion spring 40 is then compressed and received in the annular depression 118 of the rotary main body 11. The rotary main body 11 is rotated counterclockwise, and the hooks 115 are received in the corresponding sliding groove 333 and engage with the blocking portion 33. Finally, the rotary main body 11 of the control 10 is mounted into the mounting plate 30.

The limiting protrusions 113 are blocked by the blocking portion 33 until the rotary main body 11 reaches a position where the limiting protrusions 113 align with the cutouts 331. In other words, if the limiting protrusions 113 are blocked by the blocking portion 33, the contact member 13 cannot impel the resilient contact 71, such that the rotary main body 11 of the control must be rotated to activate the power supply. The contact member 13 can impel the resilient contact 71 only if the limiting protrusions 113 align with the cutouts 331. Therefore, the control mechanism 100 can prevent accidental activation.

In an alternative embodiment, the operating depressions 116 of the rotary main body 11 can be omitted or replaced by operating protrusions. It should be noted that the torsion spring 40 and the fixing board 50 can also be omitted.

It should further be noted that the configurations of the limiting protrusions 113, the cutouts 331, and sliding grooves 333 are not limited to the embodiments described. The number and configuration of the limiting protrusions 113, the cutouts 331, and the sliding grooves 333 are specifically described and illustrated for the purpose of exemplifying various aspects of the present control mechanism 100.

Finally, while various embodiments have been described and illustrated, the disclosure is not to be construed as being limited thereto. Various modifications can be made to the embodiments by those skilled in the art without departing from the true spirit and scope of the disclosure as defined by the appended claims.

What is claimed is:

1. A control mechanism, comprising:

a control comprising a rotary main body, a contact member connected to the rotary main body, and at least one limiting protrusion extending from a side of the rotary main body;

a mounting plate comprising a through hole defined therein receiving the control, and a blocking portion extending from an inner surface of the through hole, the blocking portion defining at least one cutout; and a printed circuit board comprising a resilient contact, wherein the at least one limiting protrusion is blocked by the blocking portion until the rotary main body is rotated to a portion whereby the at least one limiting protrusion aligns with the at least one cutout, such that the contact member impels the resilient contact.

2. The control mechanism of claim 1, wherein the rotary main body is a substantially circular sheet comprising a first surface and a second surface opposite to the first surface; the contact member is a shaft fixed to the second surface.

3. The control mechanism of claim 1, wherein a thickness of the at least one limiting protrusion is less than that of the rotary main body.

4. The control mechanism of claim 2, wherein the blocking portion further defines at least one sliding groove adjacent to the at least one cutout and communicating with the at least one cutout.

5. The control mechanism of claim 4, wherein the through hole of the mounting plate is substantially circular, and the at least one sliding groove extends substantially parallel to a circumference of the through hole.

6. The control mechanism of claim 5, the control further comprising a hook extending from the at least one limiting protrusion toward the mounting plate, the hook engaging with the at least one sliding groove and the blocking portion.

7. The control mechanism of claim 2, wherein the rotary main body further defines an operating depression in the first surface.

8. The control mechanism of claim 2, further comprising a torsion spring and a fixing board, the fixing board being fixed to a surface of the mounting plate away from the control, and the torsion spring being engaged between the fixing board and the rotary main body of the control to provide a restoring torsion force.

9. The control mechanism of claim 8, wherein the torsion spring comprises a columnar body having first and second ends extending therefrom.

10. The control mechanism of claim 9, wherein the second surface of the rotary main body facing the mounting plate defines a first receiving depression to receive a part of the torsion spring; the first receiving depression comprises an annular depression surrounding the contact member to receive a part of the body and an elongated depression extending from the annular depression to an edge of the second surface to receive the first end.

11. The control mechanism of claim 9, wherein the fixing board defines a through hole in a center thereof, through which the contact member passes.

12. The control mechanism of claim 11, wherein the fixing board further defines a second receiving depression at a surface of the fixing board facing the mounting plate to receive a part of the torsion spring; the second receiving depression comprising an annular depression surrounding the through hole to receive a part of the body and an elongated depression extending from the annular depression to an edge of the fixing board to receive the second end.

13. The control mechanism of claim 12, wherein the fixing board further comprises two ear portions fixed to the surface thereof facing the mounting plate; each ear portion defines a fastener hole; the fixing board is fixed to the mounting plate by the fasteners engaging with the fastener holes.

14. An electronic device, comprising:

a housing;

a control mechanism fixed to a side of the housing, the control mechanism comprising: a control comprising a rotary main body, a contact member connected to the rotary main body, and at least one limiting protrusion extending from a side of the rotary main body, a mounting plate comprising a through hole defined therein receiving the control, and a blocking portion extending from an inner surface of the through hole thereof, the blocking portion defining at least one cutout, and a printed circuit board comprising a resilient contact, wherein the at least one limiting protrusion is blocked by the blocking portion until the rotary main body is rotated to a portion whereby the at least one limiting protrusion aligns with the at least one cutout, such that the contact member impels the resilient contact.

15. The electronic device of claim 14, wherein the rotary main body is a substantially circular sheet comprising a first surface and a second surface opposite to the first surface; and the contact member is a shaft fixed to the second surface.

16. The electronic device of claim 15, wherein the blocking portion further defines at least one sliding groove adjacent to the at least one cutout and communicating with the at least one cutout.

17. The electronic device of claim 16, wherein the control further comprises a hook extending from the at least one limiting protrusion toward the mounting plate, the hook engaging with the at least one sliding groove and the blocking portion.

18. The electronic device of claim 15, further comprising a torsion spring and a fixing board, the fixing board being fixed to a surface of the mounting plate away from the control, and the torsion spring being engaged between the fixing board and the rotary main body of the control, thereby providing elastic force.

19. The electronic device of claim 18, wherein the torsion spring comprises a columnar body and first and second ends extending therefrom.

20. The electronic device of claim 19, wherein the second surface of the rotary main body facing the mounting plate defines a first receiving depression to receive a part of the torsion spring; the first receiving depression comprises an annular depression surrounding the contact member to receive a part of the body and an elongated depression extending from the annular depression to an edge of the second surface to receive the first end.

* * * * *